US006865876B2

(12) United States Patent
Landolt et al.

(10) Patent No.: US 6,865,876 B2
(45) Date of Patent: Mar. 15, 2005

(54) OPENING ROLLER UNIT OF AN OPEN-END SPINNING DEVICE

(75) Inventors: Claus-Dieter Landolt, Mönchengladbach (DE); Heinz-Georg Wassenhoven, Mönchengladbach (DE)

(73) Assignee: W. Schlafhorst AG & Co., Monchengladbach (DE)

( * ) Notice: Subject to any disclaimer, the term of this patent is extended or adjusted under 35 U.S.C. 154(b) by 7 days.

(21) Appl. No.: 10/447,566

(22) Filed: May 29, 2003

(65) Prior Publication Data

US 2003/0221407 A1 Dec. 4, 2003

(30) Foreign Application Priority Data

May 31, 2002 (DE) ..... 102 241 88

(51) Int. Cl.[7] ..... D01H 4/32
(52) U.S. Cl. ..... 57/408; 57/400; 57/412
(58) Field of Search ..... 57/400, 408–413; 19/114, 115 R; 492/35

(56) References Cited

U.S. PATENT DOCUMENTS 3,968,542 A * 7/1976 Hollingsworth ..... 19/97
4,296,527 A * 10/1981 Eadie ..... 19/112
4,352,224 A * 10/1982 Grimshaw et al. ..... 19/97
4,574,583 A * 3/1986 Stahlecker et al. ..... 57/408
4,805,395 A * 2/1989 Stahlecker et al. ..... 57/408
5,943,854 A * 8/1999 Schuller et al. ..... 57/408
6,105,355 A 8/2000 Winzen et al. ..... 57/406

FOREIGN PATENT DOCUMENTS

| | | |
|---|---|---|
| DE | 29 04 841 A1 | 8/1980 |
| DE | 31 23 480 C2 | 6/1986 |
| DE | 44 11 735 A1 | 10/1995 |
| DE | 35 15 153 C2 | 7/1996 |
| DE | 198 41 406 A1 | 6/1999 |
| EP | 0 627 510 A1 | 12/1994 |

OTHER PUBLICATIONS

German Search Report.

* cited by examiner

*Primary Examiner*—John J. Calvert
*Assistant Examiner*—Shuan R Hurley
(74) *Attorney, Agent, or Firm*—Kennedy Covington Lobdell & Hickman, LLP

(57) ABSTRACT

A generally cylindrical opening roller unit of an open-end spinning device includes a unitary ring body having card clothing formed of at least one helical groove formed in the ring body, at least one helical ridge between courses of the groove, and saw teeth defined by transverse cuts on the ridge. The roller unit also includes an integrated annular collar that is at least codiametric with the teeth in order to protect the teeth. An integral transition area between the card clothing and the annular collars eliminates the problem of a tooth gap.

8 Claims, 3 Drawing Sheets

OPENING ROLLER UNIT OF AN OPEN-END SPINNING DEVICE

CROSS-REFERENCES TO RELATED APPLICATIONS

This application claims the benefit of German patent application 10224188.0, filed May 31, 2002, herein incorporated by reference.

BACKGROUND OF THE INVENTION

The invention relates generally to an opening roller unit of an open-end spinning device and more specifically to such a unit wherein the card clothing includes a helical groove, a number of ridges between the courses of the groove, and saw teeth cut into the ridges by a series of transverse cuts, as well as annular collars on the ends of the card clothing.

Opening roller units of open-end spinning devices, which are used for opening slivers supplied to them, are well known in the art to which the present invention relates. One kind of opening roller is known from German Patent Publication No. DE 29 04 841 A1, whose card clothing includes a saw-toothed wire wound on the roller body of the opening roller. In such a case the saw-toothed wire can be wound on the cylindrical surface of the opening roller, or it can be inserted into a helical groove. In practice, the end areas of the saw-toothed wire are not provided with teeth but are instead used for fixing the saw-toothed wire in place on the roller body, typically by pushing the ends into a depression in the helical groove.

German Patent Publication No. DE 31 23 480 C2 discloses an opening roller unit consisting essentially of a base body and a ring, wherein the ring is connected, and fixed against rotation, to the base body. A saw-toothed wire set into a helically circulating groove is wound on the outer circumferential surface of the ring. In place of sawteeth, the ring can be alternatively equipped with individual needles inserted into bores. The ring of the opening roller is embodied with annular collars arranged at the sides of the wound-on saw-toothed card clothing. Because the ring can be removed from the base body, it becomes possible to clean the area between the bearing housing and the opening roller relatively easily without elaborate disassembly of the opening roller unit.

German Patent Publication No. DE 44 11 735 A1 also discloses an opening roller of an open-end spinning device, which comprises a base body and cylindrical card clothing supported with integrated annular collars. The design is intended to permit simple mounting and dismounting, such as for maintenance, as well as for uncomplicated cleaning of the opening roller unit. The card clothing placed on the card clothing support consists of a saw-toothed wire wound on the outer circumference, or of rows of helically-arranged needles, which have been pushed into bores.

The saw-toothed wire of known opening rollers is generally not wound completely up to the annular collars in the edges of the card clothing, or, in some arrangements, the section of the wire near the annular collars has no teeth, as can be seen in FIG. 2 of German Patent Publication No. DE 29 04 841 A1. Regardless, in such arrangements there is a "free" space, in which no teeth are provided, between the area in which there are teeth and the annular collar. The width of this free space can here be greater than the distance between the rows of teeth over the width of the working area, and the distance between the teeth is called a tooth gap. Such a free space can be clearly seen in the respective FIG. 1 of DE 29 04 841 A1 or DE 31 23 480 C2, for example.

An opening roller is known from DE 35 15 153 C2, wherein the teeth have been cut out of the outer circumference of the sleeve constituting the card clothing. In order to form the teeth, at least one groove, which substantially circulates helically in the circumferential direction, and several cuts that extend in a substantially axial direction, have been cut. Prior to making the cuts, and perhaps even prior to cutting the helically circulating groove, the sleeve is subjected to a surface treatment process, such as hardening, for example. A particularly high wear resistance and true operating consistency of the opening roller can be achieved when a toothed card clothing is produced in this manner from a hardened sleeve.

With opening roller units of this type, the saw-toothed card clothing unit is arranged between two separate components, called annular collars, and is fixed in place by them. In accordance with the disclosed prior art, the teeth are always completely formed up to the edge of the card clothing unit.

It is furthermore customary to reduce the height of the teeth in the edge area of the card clothing. In this manner the danger of damage to the sawteeth in the edge area of the card clothing can be reduced as long as the card clothing is not yet enclosed by annular collars.

If the fiber material of the sliver is not fed to the opening roller at sufficient thickness and evenly distributed across the width of the roller up to the annular collars, it is possible that, in areas in which no material is fed and there is therefore no seal against the ambient air, air is aspirated through the tooth gaps at an increased flow speed, because of the vacuum pressure in the rotor housing of the open-end spinning device as compared with the circumferential speed of the opening roller. While this can occur at any place across the working width where an insufficient amount of fiber material is supplied, the problem is limited to a large extent to the edge areas. If the above-described free spaces exist in the edge area, the aspirating effect is particularly strong. Because of the increased air flow, fiber material which has not yet opened, or which has been opened insufficiently, is aspirated through the free spaces and carried along. In this manner, fiber material can reach the spinning rotor without having been opened, which can interfere with the yarn production process at the spinning rotor. For example, in such situations, the yarn leaving the spinning rotor can have undesirable imperfections in the form of undrafted parts.

SUMMARY OF THE INVENTION

It is therefore an object of the present invention to provide for an improved opening roller unit that avoids the aforementioned problems in conventional opening roller units.

In accordance with this object, the opening roller unit of the present invention includes a generally cylindrical opening roller unit of an open-end spinning device having a card clothing formed by at least one helical circulating groove, a helical ridge disposed between courses of the groove, and a plurality of saw teeth formed by transverse cuts on the helical ridge. At least one annular collar disposed at an end of the roller unit, and a transition area is provided between the saw teeth and the at least one annular collar.

In the present invention, an opening roller unit is provided in which the number of components of the opening roller unit is minimized and which permits assembly and disassembly to be simple and rapid. Specifically, the grooves, and the cuts extending transversely to the ridge, are formed centrally, without necessarily extending to the end of the roller unit, such that a solid annular collar of unground material remains at least one end of the roller unit. In this manner, the uncontrolled aspiration of unopened fiber material is prevented, and the danger of interference or yarn defects during the yarn production process is reduced. A sufficient protection of the teeth is provided if the diameter of the annular collar is at least large enough that the teeth do not project past (i.e., beyond the profile of) the annular collar. Moreover, because the annular collar and the teeth are produced simultaneously, the teeth are protected against damage from the start and continuously.

A partial advantage, both as noted above and because of greater efficiency in assembly and disassembly and the number of component parts, can be realized if an integrated annular collar is provided on only one end of the opening roller unit. However, the full advantage of the invention can be realized by providing an integrated annular collar on each end of the opening roller unit.

In a further feature of the present invention, the tooth-forming cuts in the ridges have a directional course that is preferably not parallel with the axis of the opening roller unit. Instead, the directional course forms an angle $\delta$ with respect to the axis. This feature of the present invention improves the formation of the teeth in the edge area, particularly when the teeth are to be cut out by disk-shaped tools, such as a grinding wheel.

The teeth, and specifically the tips thereof, are preferably provided with a vertex angle $\alpha$ of no more than 30 degrees. A configuration according to this further feature of the present invention is particularly effective at opening the sliver.

Consistent with conventional embodiments of opening roller units, the teeth of which are ground and cut from a solid blank, a high degree of production accuracy, operating consistency, and great hardness and wear resistance can be obtained in the present invention, in combination with the advantages provided by integrated annular collars, such as simple and quick assembly and disassembly and a reduction in the number of components to be produced and assembled.

Additionally, in conventional opening roller units, it has been assumed for manufacturing purposes that the transverse cuts to be ground into the ridges between courses of the helical groove must extending transversely through the whole face of the opening roller unit, particularly through the ends. In the present invention, however, the production of the opening roller unit is simplified in that the teeth near the ends of the saw-toothed card clothing are not completely formed. This incomplete formation of the teeth effectively creates a transition area between the working area of the card clothing and the integrated annular collars. Stated another way, the depth of the groove in the region near the ends is gradually decreased in the direction toward the ends. In this manner, the incomplete nature of the formation of the teeth prevents undesired negative effects in the opening process of the fiber material. Free spaces through which insufficiently opened fiber material might otherwise be aspirated and carried along are avoided, as are the disadvantages connected therewith.

In addition to the operating efficiencies realized in the present invention, the present invention reduces the necessary outlay for production and assembly, improves the yarn production process, and increases the efficiency of open-end spinning devices.

BRIEF DESCRIPTION OF THE DRAWINGS

Further features, embodiments, and advantages of the present invention will be identified in connection with the drawings, wherein.

DETAILED DESCRIPTION OF THE PREFERRED EMBODIMENTS

Figure 1:
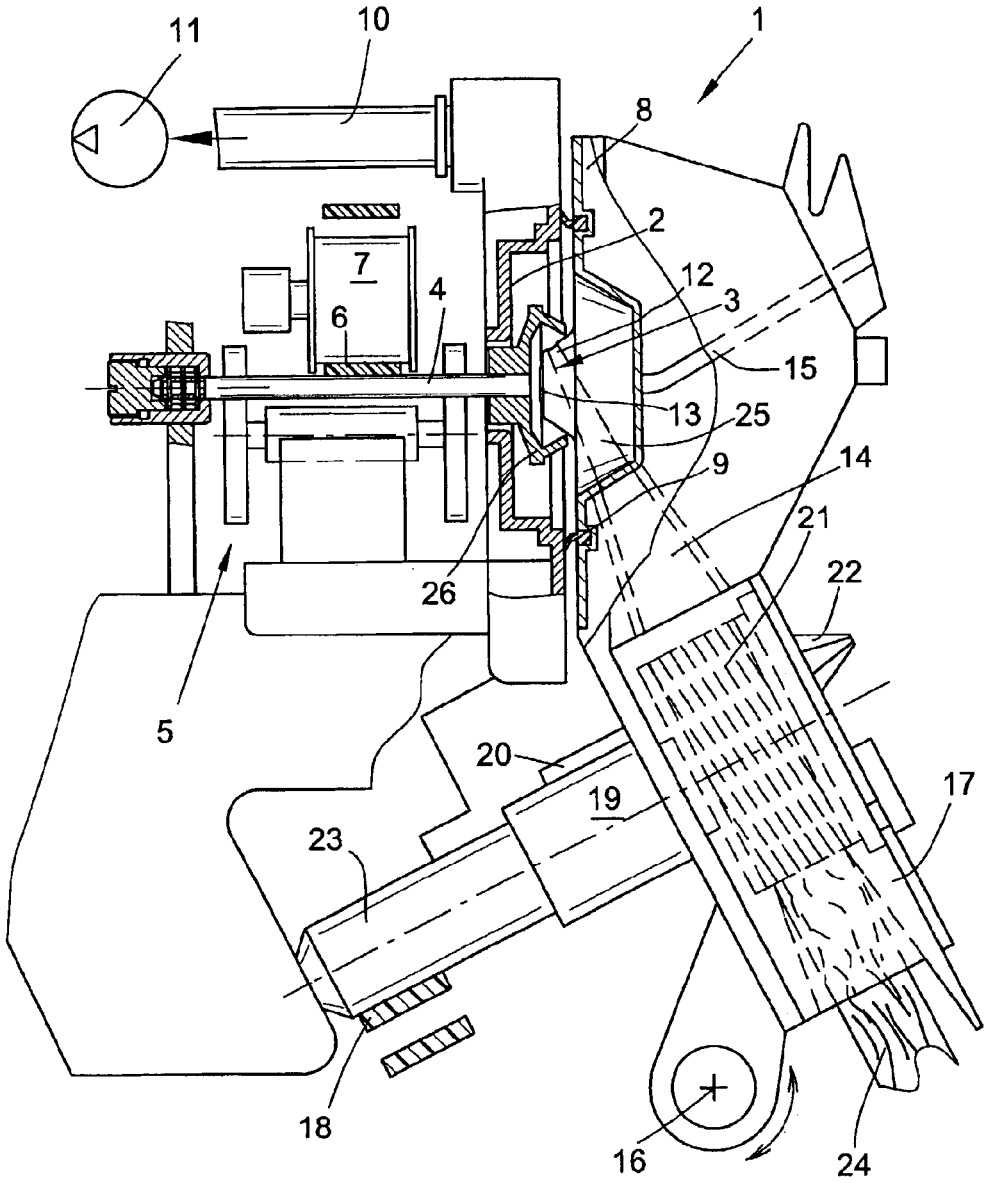
FIG. 1 is a schematic representation of an open-end spinning device in a lateral view and partial cross-section.

The open-end spinning device 1 represented in FIG. 1 comprises a rotor housing 2, in which a spinning rotor 3 rotates at high speed. The rotor shaft 4 of the spinning rotor 3 is supported in the bearing nip of a supporting disk bearing 5. As is customary, the spinning rotor 3 is driven via a tangential belt 6 extending over the length of the machine, which is pressed against the rotor shaft 4 by a pressure roller 7. The tangential belt 6 is actuated by means of a reversible and frequency-controlled electric motor, not represented. As is customary, the rotor housing 2 is closed during the spinning operation by means of a pivotably seated cover element 8. For this purpose, the cover element 8 has a conduit plate 12 with a seal 9. The rotor housing 2 is connected via an appropriate suction line 10 to a vacuum source 11, which generates the required spinning vacuum in the rotor housing 2.

A conduit plate adapter, which contains the yarn draw-off nozzle 13, as well as the mouth area 25 of the fiber guide conduit 14, is arranged in a receiver of the conduit plate 12. A small yarn draw-off tube 15 is attached to the yarn draw-off nozzle 13. An opening roller housing 17 is fixed on the cover element 8, and the opening roller housing 17 is seated so that it is pivotable to a limited extent around a pivot shaft 16. The cover element 8 has rear bearing brackets 19, 20 for seating an opening roller 21 and a sliver draw-in cylinder 22. The opening roller 21 is driven in the area of its wharve 23 by a circulating tangential belt 18, which extends over the length of the machine, while the sliver draw-in cylinder 22 is preferably driven by means of a worm gear arrangement, not represented. Further details of such an open-end spinning device can be found in U.S. Pat. No. 6,105,355, for example.

The opening roller 21 supports a toothed card clothing and rotates at a high number of revolutions. A sliver 24 is fed to the opening roller 21, which sliver is grasped by the teeth and taken along and is opened into single fibers in this way. The individual fibers are released from the teeth of the opening roller 21 and are conveyed by the vacuum present in the rotor housing 2 through the mouth area 25 of the fiber guide conduit 14 into the rotor cup 26. The yarn is formed in the rapidly rotating rotor cup 26 and is drawn off through the yarn draw-off nozzle 13 and the small yarn draw-off tube 15.

Figure 2:
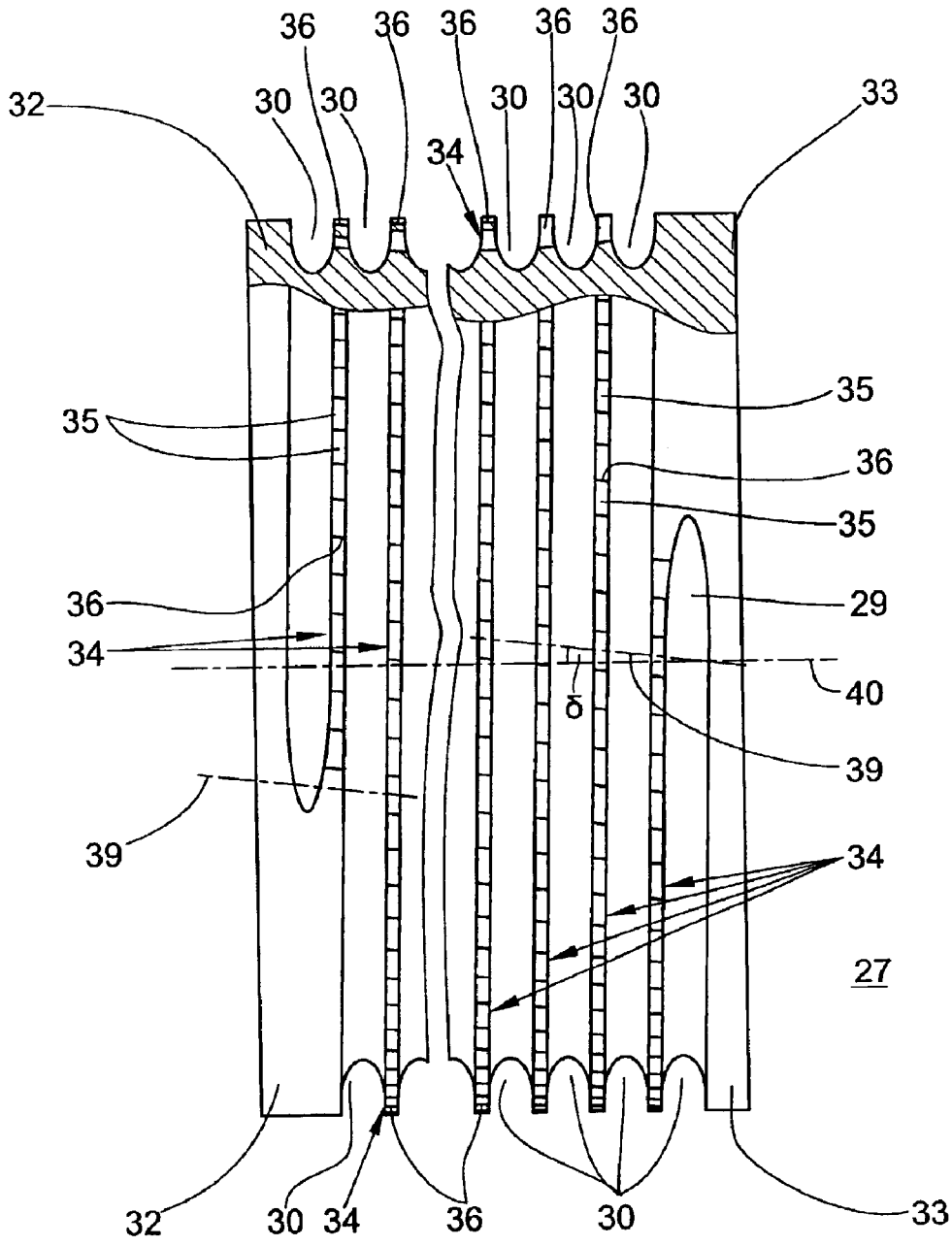
FIG. 2 is a simplified representation of an opening roller unit in accordance with the present invention.

Referring now to FIG. 2, the opening roller unit 27 represented in FIG. 2 is generally cylindrical and comprises a unitary ring body 27 having card clothing formed of at least one helical groove 30 formed in the ring body 27, at least one helical ridge 34 disposed between courses of the groove 30, and a plurality of saw teeth 36 defined by transverse cuts on the at least one ridge 34. The unit has annular collars 32, 33, which are integrated with, in a preferred embodiment, each end of the opening roller unit 27. An integral transition area 29, which will be described in greater detail below, is disposed between the card clothing and the annular collar 33. Such opening roller units can be single- or multi-grooved. The opening roller unit 27 shown in FIG. 2 is double-grooved, i.e. two grooves circulate next to each other.

Figure 3:
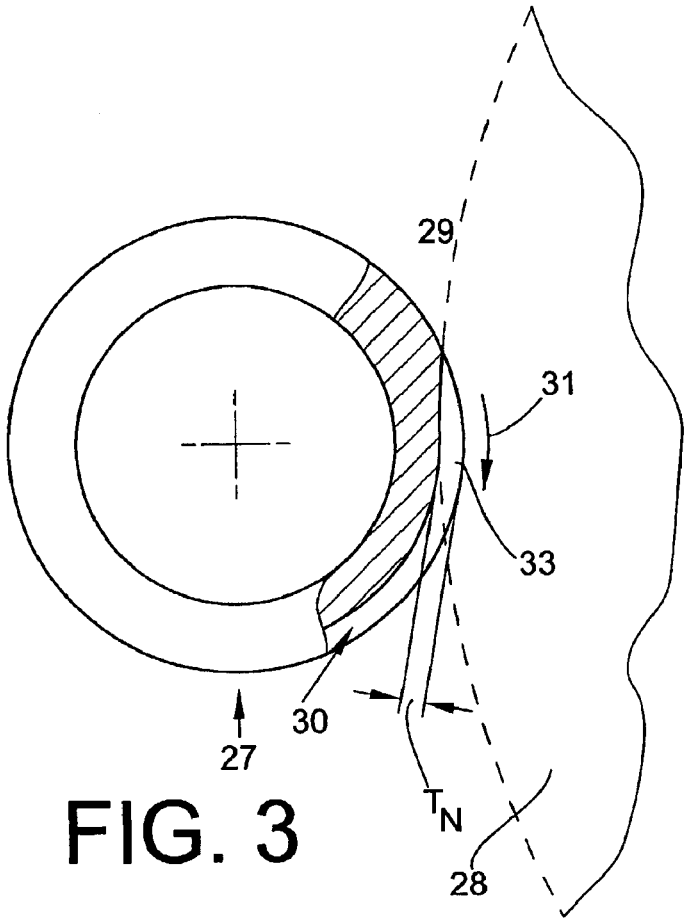
FIG. 3 is a partial cross-sectional view as in FIG. 2, during the production of the opening roller unit.

One difference between the opening roller unit 27 and known opening roller rings whose teeth have been formed out of a sleeve lies in that the grooves 30 are not formed with their full groove depth $T_N$ (see FIG. 3) continuously up to the end of the card clothing, but instead terminate at a distance from the end corresponding to the width of the annular collar 32, 33. This arrangement is produced during manufacturing of the opening roller unit 27 by grinding out the grooves, starting from the end, such that the grinding wheel does not initially penetrate the surface of the opening roller unit 27 at the full groove depth $T_N$ of the circulating grooves 30, but instead dips into it slowly. By means of this a transition area 29 is formed on the annular collar 33, in which the depth of the groove 30 increases in the direction of the arrow 31, as can be seen in FIG. 3, until the full groove depth $T_N$ has been reached. Correspondingly, the depth of the groove 30 slowly decreases in the transition area at the other end, and the grooves 30 terminate at a distance from the end corresponding to the width of the annular collars 32, 33.

FIG. 3 represents the opening roller unit 27 of FIG. 2 in one phase of its production. A grinding disk 28 for cutting the circulating grooves is indicated by dashed lines. The principle of cutting circulating grooves into opening roller rings is known from German Patent Publication No. DE 35 15 153 C2 and will not be explained in further detail here.

The grooves 30, and also the cuts 35 extending transversely to the ridges 34 or the grooves 30, end at such a distance from the end of the opening roller unit 27 that the material of the sleeve remains as annular collar 32, 33 at the edges of the opening roller unit 27. The outer diameter of the annular collar 32, 33 is of such a size that the teeth, and more particularly the tips of the teeth, do not project past the annular collar 32, 33, but are at most codiametric with the outer diameter of the annular collar 32, 33. The teeth 36 are formed out of the ridges 34 remaining between the grooves 30. The cuts 35, together with the helix-like circulating grooves 30, constitute the teeth 36 with the face surfaces 37 and the back surfaces 38.

Just as with the grooves 30, the cuts 35 have been made by means of a grinding wheel. In FIG. 2, the lines 39, which indicate the directional course of the cuts 35, form an acute angle $\delta$ with the axis 40 of the opening roller unit 27. This arrangement permits a wider tooth design in the transition area when wheel-shaped tools are employed for producing the opening roller unit 27.

Figure 4:
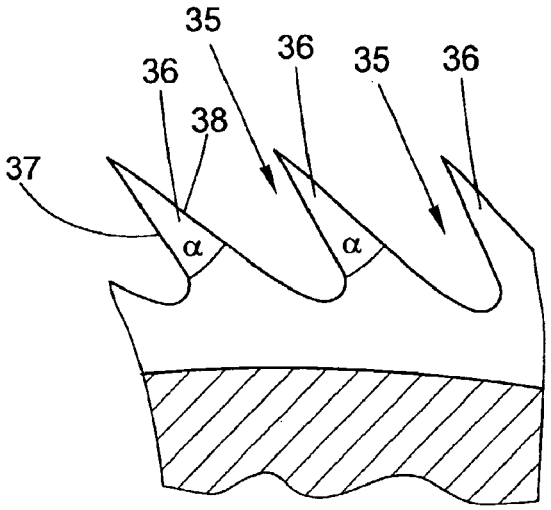
FIG. 4 is a partial view of a row of teeth of the opening roller unit as in FIG. 2, in partial cross-section.

Referring now to FIG. 4, the tips of the teeth 36 have a vertex angle $\alpha$ of at most 30 degrees which is formed by the face surfaces 37 and the back surfaces 38. The shape of the teeth 36 formed in this way permits a particularly effective and even opening process of the supplied sliver 24.

Further embodiments of the opening roller unit are possible within the framework of the invention. For example, the cuts which create the face surfaces and back surfaces of the teeth can be axially oriented and extend axis-parallel. Alternatively the opening roller unit can be designed in such a way that the outer diameter of the annular collars is greater than the diameter of the opening roller unit in the card clothing area.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A unitary opening roller for an open-end spinning device, comprising:

a roller unit comprising a cylindrical ring body and at least one annular collar unitary with an end of the ring body, the ring body having card clothing formed peripherally thereabout by (a) at least one helical groove formed in the ring body, the groove including at one terminal end thereof an integral transition area of gradually decreasing groove depth, adjacent to the at least one annular collar, said area gradually transitioning the groove into the at least one annular collar, (b) at least one helical ridge disposed between courses of the groove, and (c) a plurality of saw teeth defined by transverse cuts on the at least one ridge.

2. The opening roller unit of claim 1, wherein the at least one groove terminates at a sufficient distance from the end to form the collar.

3. The opening roller unit of claim 1, comprising one annular collar disposed at each end of the roller unit.

4. The opening roller unit of claim 1, wherein the tooth-forming cuts have a directional course that forms an acute angle $\delta$ with respect to the axis of the opening roller unit.

5. The opening roller unit of claim 1, wherein the saw teeth have a vertex angle $\alpha$ of less than about 30° degrees.

6. The opening roller unit of claim 1, wherein the teeth are incompletely formed in the transition area.

7. The opening roller unit of claim 1, wherein the annular collar has a diameter large enough that the teeth do not project beyond the annular collar.

8. A generally cylindrical opening roller unit of an open-end spinning device, comprising: a unitary ring body having card clothing formed of at least one helical groove formed in the ring body, at least one helical ridge disposed between courses of the groove, and a plurality of saw teeth defined by transverse cuts on the at least one ridge; at least one annular collar integrated with an end of the roller unit and an integral transition area between the card clothing and the at least one annular collar, wherein the teeth are incompletely formed in the transition area.

* * * * *